US005355964A

United States Patent [19]

White

[11] Patent Number: 5,355,964

[45] Date of Patent: Oct. 18, 1994

[54] PILE DRIVING AND/OR PILE PULLING VIBRATORY ASSEMBLY WITH COUNTERWEIGHTS

[76] Inventor: John L. White, 7032 S. 196th, Kent, Wash. 98032

[21] Appl. No.: 90,891

[22] Filed: Jul. 12, 1993

[51] Int. Cl.[5] ..... E02D 7/18; E21B 7/24

[52] U.S. Cl. ..... 173/1; 173/49; 175/56; 405/232

[58] Field of Search ..... 173/49, 141, 162.1, 173/1; 405/232; 175/56

[56] References Cited

U.S. PATENT DOCUMENTS

| | | | |
|---|---|---|---|
| 2,350,921 | 6/1944 | Pinazza | 173/49 |
| 4,144,939 | 3/1979 | Knothe | 173/49 |
| 4,285,405 | 8/1981 | Weir, Jr. | 173/49 |
| 4,819,740 | 4/1989 | Warrington | 173/49 |
| 5,088,565 | 2/1992 | Evarts | 173/49 |
| 5,263,544 | 11/1993 | White | 173/49 |

*Primary Examiner*—Scott A. Smith
*Attorney, Agent, or Firm*—Seed and Berry

[57] ABSTRACT

A pile driving and/or pile pulling vibratory assembly for imparting a vibratory force to a pile wherein the vibratory assembly has a housing and a pair of counterweights rotatably carried in receiving areas within the housing. The counterweight has a cylindrical gear portion and an eccentric weight portion integrally formed therewith. The eccentric weight portion has insert-receiving areas therein that are adapted to each receive a solid tungsten rod. The solid tungsten rod is adhered within the insert receiving area with an adhesive. Driving motors are operatively connected to the counterweights and are adapted to rapidly rotate the counterweights within the housing in order to generate substantial vibratory forces.

27 Claims, 4 Drawing Sheets

PILE DRIVING AND/OR PILE PULLING VIBRATORY ASSEMBLY WITH COUNTERWEIGHTS

TECHNICAL FIELD

This invention relates to pile driving and pile pulling equipment, and more particularly to vibratory pile driving and pile pulling equipment utilizing counterweights.

BACKGROUND OF THE INVENTION

Pile driving and pile pulling equipment, hereinafter collectively referred to as pile driving equipment, is used to drive large piles into the earth to form a stable support for buildings or other structures. Similarly, the pile driving equipment is used to remove large piles from the earth. U.S. Pat. No. 5,117,925 discloses pile driving equipment with a vibratory apparatus that imparts a vibration force to the pile. These vibratory pile driving devices have recognized several advantages over pile driving equipment that uses hammer devices to drive the pile, including an increased driving speed.

The vibratory apparatus to generate extremely high driving and pulling forces by rapidly rotating large counterweights within vibratory assembly. The counterweights are large cylindrical, eccentrically weighted gears, i.e., they have an uneven weight distribution around the body of the gear such that its center of gravity is radially outward of the gear's rotational axis. When the vibratory apparatus rapidly rotates two counterweights in opposite directions, the counterweights generate substantial vibratory forces that are transmitted through the vibratory assembly, through a pile holding device, and to the pile. However, this rapid rotation also creates large stress loads within the counterweights themselves. High temperatures in and around the counterweights are also generated, because friction between the moving components.

The prior art includes a vibratory assembly with counterweights having a solid eccentric weight bolted to a portion of a cylindrical gear. These bolted counterweights are not sufficiently durable, because the bolts have a very undesirable tendency to break under the large stress loads generated during rotation counterweights. Another prior art vibratory assembly avoids this breaking problem by using a cast, one-piece, solid counterweight having an eccentric weight portion integral with a cylindrical gear portion. These solid, cast counterweights, however, do not have sufficient mass to generate large enough vibratory forces to efficiently drive or pull piles.

Attempts have been made to increase the mass of such cast counterweight by machining or casting bores in the eccentric weight portion, pouring molten lead into the bores, and allowing the lead to cool and solidify. These lead-filled counterweights, however, produce a limited degree of vibration amplitude in that one rotation of such counterweights only moves the vibratory apparatus vertically less than one inch. In addition, the elevated temperatures from the friction between moving components cause the lead to become somewhat fluid and shift during operation. The shifting lead results in unbalanced weight distribution in the counterweights, which creates undesirable lateral forces that can damage the vibratory assembly. Although the prior art devices lubricate the moving components with oil, the amount of friction is still sufficient to generate high temperatures. The balance problem is also partially caused by the inability to fill the bores with precise amounts of molten lead.

Yet a further problem experienced with lead-filled counterweights is that the lead inserts can be chipped or shaved off during operation, or otherwise contact the oil, and the loose lead contaminates the oil and creates an environmentally hazardous waste. This hazardous waste requires proper and expensive disposal procedures.

As a result of the above-described limitations, there have not heretofore been acceptable solutions to the problems of providing a vibratory assembly that is durable, easy to manufacture, sufficiently balanced, and capable of withstanding elevated temperatures without producing disadvantageous lateral forces and environmentally hazardous waste material and lower vibratory force than desired.

SUMMARY OF THE INVENTION

The present invention provides a vibratory assembly used in vibratory pile driving equipment for imparting vibratory forces on a pile. The vibratory assembly has a housing that is adapted to be coupled to a shock absorbing device and to a pile holding device used in a vibratory pile driver. The housing has at least one counterweight receiving area adapted to rotatably receive at least one counterweight. The counterweight is made of a metal and has a cylindrical gear portion with an integral eccentric weight portion. The eccentric weight portion has at least one insert-receiving area formed therein. A solid insert member made of a second metal, which is different than the first metal of the counterweight, securely fits within the insert-receiving area. The second type of metal has a specific gravity greater than the specific gravity of the first metal, and a melting point temperature greater than 328° C. such that the second metal will not become fluid and shift during operation of the vibratory assembly. At least one motor is operatively coupled to the counterweight and is adapted to rotate the counterweight to cause the vibratory forces.

In one embodiment of the present invention, the vibratory assembly has a housing having two counterweight receiving areas with one counterweight positioned in each of the counterweight receiving areas. Each counterweight has two insert receiving areas therein, and each insert receiving area is sized to receive one solid tungsten rod insert member. The solid tungsten rod insert member is secured within the insert receiving area with an adhesive.

The present invention further provides a method of making a counterweight assembly adapted to rotatably fit in a vibratory assembly. The counterweight assembly having a cylindrical gear portion and an integral eccentric weight portion is cast with a first metal such as steel. An insert receiving area cast into the eccentric weight portion is bored to receive a solid insert member. The solid insert member is inserted into the insert receiving area and adhered therein with an adhesive. The counterweight assembly is balanced and marked to indicate where to begin cutting gear teeth. Gear teeth are then cut into the cylindrical gear portion around its perimeter. The counterweight is balanced again so the center of gravity of the eccentric weight portion is properly aligned with the gear teeth.

In this embodiment of the method, the cast counterweight with the solid inserts installed is weighed and mass is removed from the eccentric weight portion to balance the counterweight assembly and to reduce its weight. After the counterweight has achieved the desired weight, shape, and balance, the counterweight is operative installed into the counterweight receiving of the housing of the vibratory assembly.

BRIEF DESCRIPTION OF THE DRAWINGS

The present invention will be more clearly understood from the following detailed description of the preferred embodiment taken in conjunction with the attached drawings.

DETAILED DESCRIPTION OF THE INVENTION

Figure 1:
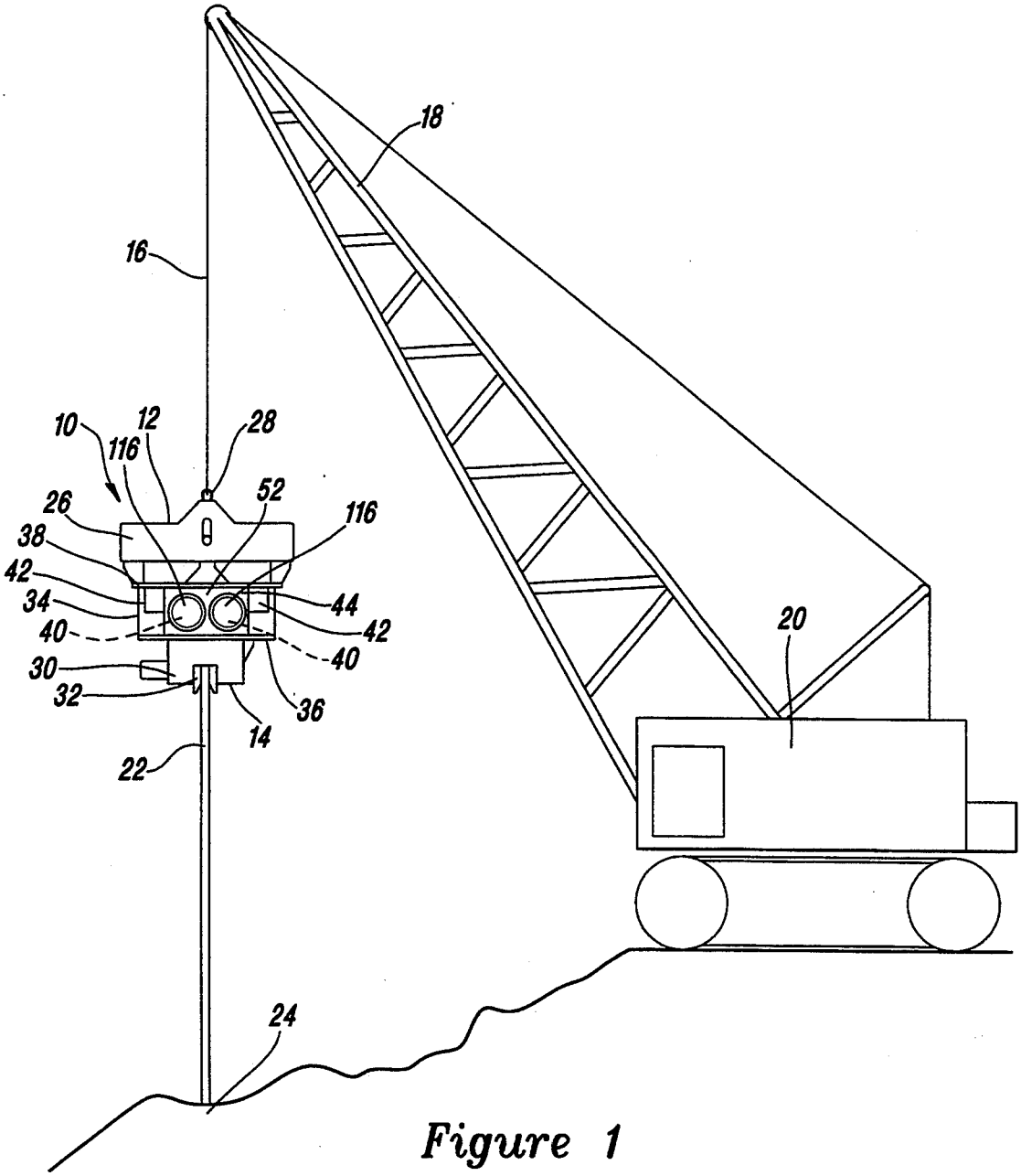
FIG. 1 is a schematic side elevation view showing vibratory pile driving equipment having a vibratory assembly of the present invention suspended from a crane and engaging a pile.
Figure 2:
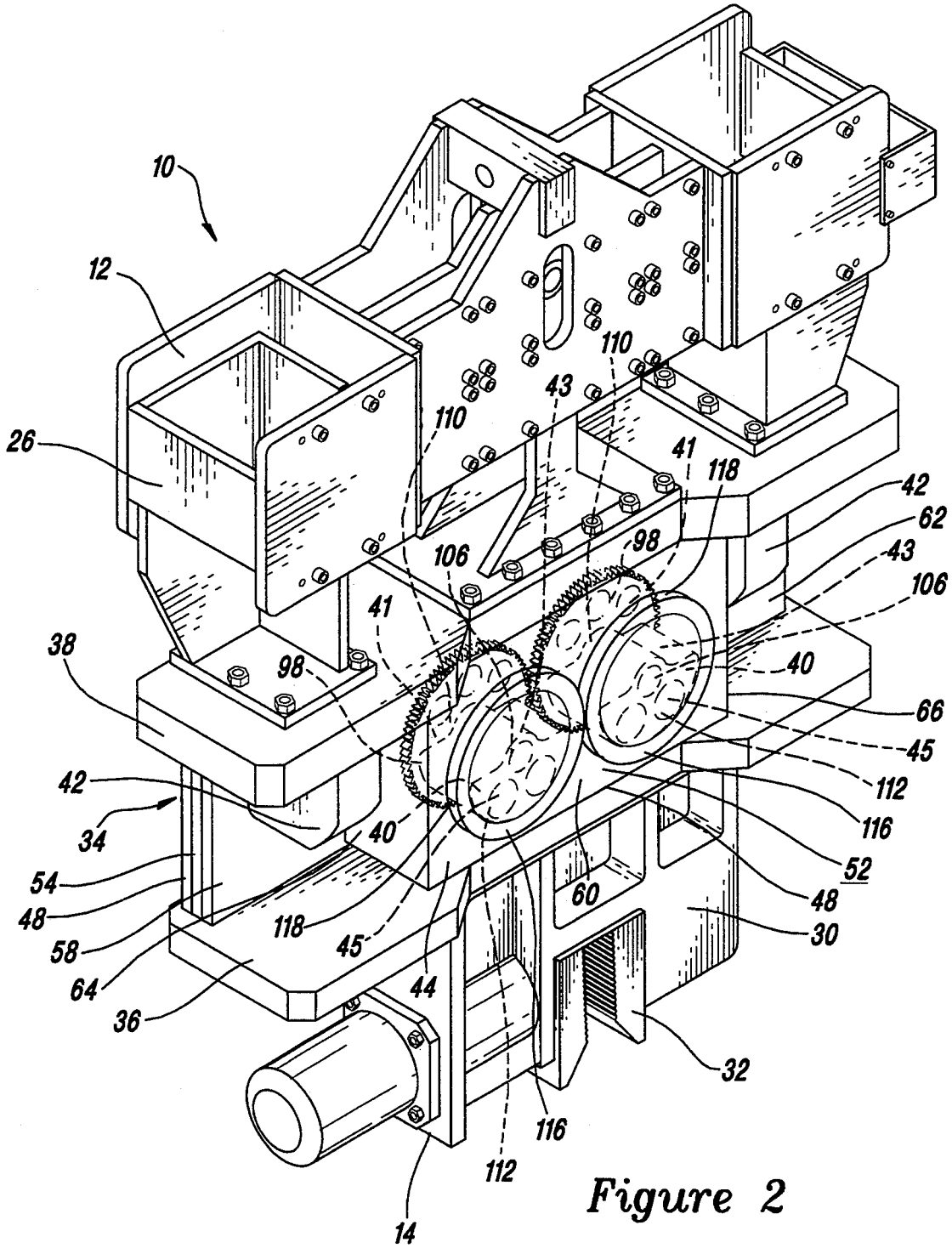
FIG. 2 is an enlarged isometric view of the vibratory assembly of FIG. 1 showing two counterweights rotatably mounted therein.

As shown in FIGS. 1 and 2 for purposes of illustration, the present invention is embodied in a vibratory pile driver 10 that is connected at its top 12 to a cable 16 and suspended from a boom 18 of a crane 20 or the like. The vibratory pile driver 10 is connected at its bottom 14 to a pile 22 that is to be driven into or pulled out of the ground 24. The vibratory pile driver 10 has three major components: a shock absorbing device 26 that connects to the cable 16, a pile holding device 30 that securely grasps the pile 22, and a vibratory assembly 34 of the present invention that is positioned between the shock absorbing device and the pile holding device.

The vibratory assembly 34 generates substantially vertical vibratory forces by rotating at high speeds two counterweights 40 within a housing 44. Each counterweight 40 has a gear portion 41 and an eccentric weight portion 43 that is integral to the gear portion. The eccentric weight portion 43 has dense, solid, metal inserts 45 mounted therein to increase the mass of the eccentric weight portion, and to position the center of gravity of the counterweight 40 radially outward from its rotational axis. The vibratory forces are transmitted through the pile holding device 30 and imparted to the pile 22. The shock absorbing device 26 greatly dampens the vibratory forces that are transmitted toward the top 12 of the vibratory pile driver 10 such that the vibratory forces communicated to the cable 16 or boom 18 are minimized.

As best seen in FIG. 2, the vibratory assembly 34 has a bottom plate 36 that is bolted securely to the pile holding device 30, and a top plate 38 that is bolted securely to the shock absorbing device 26. The preferred embodiment of the vibratory assembly 34 uses two counterweights 40 that are driven by two drive motors 42, however, a vibratory assembly can incorporate different numbers of counterweights and one or more motors. The drive motors 42 rotates the counterweights 40 at high speeds about its rotational axis whereby the eccentric weight portions 43 of the two counterweights 40 generate large vertical vibratory forces.

Figure 4:
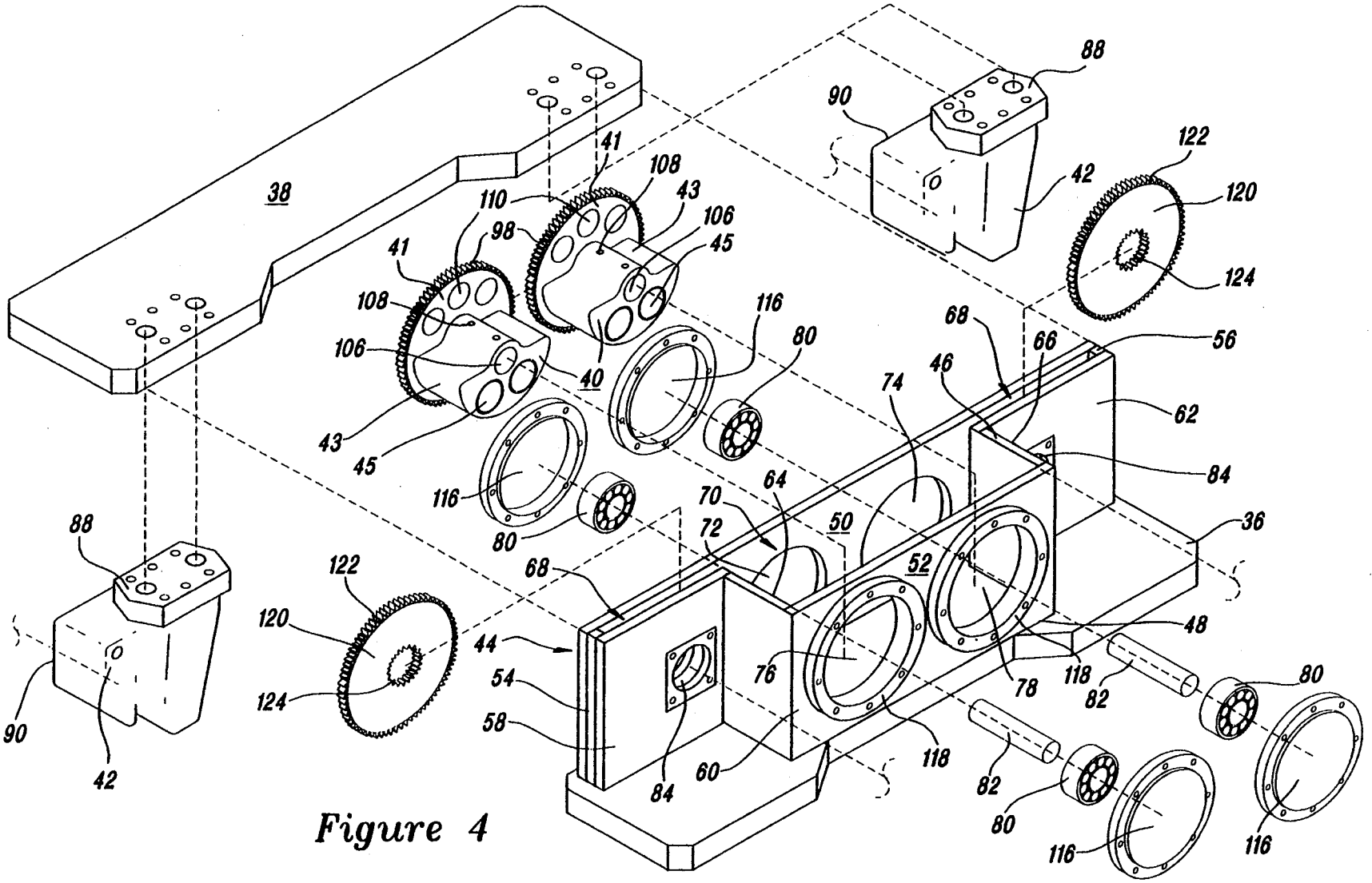
FIG. 4 is a reduced scale, exploded isometric view of the vibratory assembly of FIG. 2.

A housing 44 for the vibratory assembly 34 is connected along its top surface 46 to the top plate 38, and is connected along its bottom surface 48 to the bottom plate 36. The housing 44 is laterally centered with respect to the top and bottom plates 38 and 36 to provide a substantially balanced and symmetrical vibratory pile driver 10. Referring to FIGS. 2 and 4, the housing 44 has a plurality of interconnected panels. The panels include a rear panel 52, a contoured front panel 52, a left side panel 54, and a right side panel 42. Each of the panels 50, 52, 54, and 56 are perpendicularly oriented relative to the top and bottom plates 38 and 36.

The contoured front panel 52 has a left front panel 58, a center panel 60, and a right front panel 62, each of which is parallel to the rear panel 50 and perpendicularly oriented relative to the top and bottom plates 38 and 36. The contoured front panel 52 further has left sidewall 64 and a right sidewall 66 that are perpendicularly oriented relative to the top and bottom plates 38 and 36, and perpendicularly oriented relative to the left front, center, and right front panels 58, 60, and 62, respectively. The left sidewall 64 connects to the left front panel 58, extends away from the rear panel 50 and connects to the left side of the center panel 60. Similarly, the right sidewall 60 connects to the right front panel 62, extends away from the rear panel 50 and connects to the right side of the center panel 60.

The contoured front panel 52 is positioned forward of the rear panel 50 such that a space is provided therebetween. Thus, a side compartment 68 is formed between the rear panel 50 and the left and right front panels 58 and 62, and a larger central compartment 70 sized to rotatably receive the counterweights 40 is formed between the rear panel 50 and the center panel 60. The left and right side panels 54 and 56 connect to the rear panel 50 and to the left and right front panels 58 and 62, respectively, to close the side compartment 68 on the left and right sides of the housing 44. Accordingly, the rear panel 50, left and right side panels 54 and 56, left and right front panels 58 and 62, and the center panel 60 each connect to the top and bottom plates 38 and 36 to form an interior open T-shaped housing, wherein the side compartments 68 are in the flanges of the T and the larger central compartment 70 is in the web of the T, as best seen in FIG. 4.

Still referring to FIG. 4, the rear panel 50 has two perpendicularly oriented apertures, a left rear aperture 72 and a right rear aperture 74. Similarly, the center panel 60 has two perpendicularly oriented apertures, a left front aperture 76 that is coaxially aligned with the left rear aperture 72, and a right front aperture 78 that is coaxially aligned with the right rear aperture 74. Each of the left front and rear apertures 76 and 72, and the right front and rear apertures 78 and 74 are adapted to securely receive a cylindrical bearing assembly 80 that rotatably supports a counterweight shaft 82 that is adapted to carry one counterweight 40 within the central compartment 70. The shaft 82 extends from bearing 80 in the rear panel 50, span the central compartment 70, and into a bearing in the center panel 60.

Similar to the center panel 60, the left and right front panels 58 and 60 have perpendicularly oriented side apertures 84 therein, each of which is adapted to receive one of the drive motors 42 that attaches to the top plate 38. One drive motor 42 is attached to the top panel 36 adjacent to the left sidewall 64, and another drive motor is attached to the top panel adjacent to the right sidewall 66. The preferred drive motor 42 is an L-shaped, hydraulic, spherical piston motor having a top face 88 that engages the top plate 38 and a bottom face 90 that is perpendicularly oriented relative to the top plate. The bottom faces 90 of the drive motors 86 are attached to the left and right front panels 58 and 62, and cover the side apertures 84 therein. The drive motors 42 have a shaft (not shown) coaxially aligned with the side apertures 74 extending from the bottom face 90, through the side apertures 84, and into the side compartment 68 between the rear panel 50 and the left and right front panels 58 and 62. Thus, the drive motors 42 and their shafts are positioned adjacent to the housing 44 and operatively coupled to the counterweights 40 to rotatably drive them.

Figure 3B:
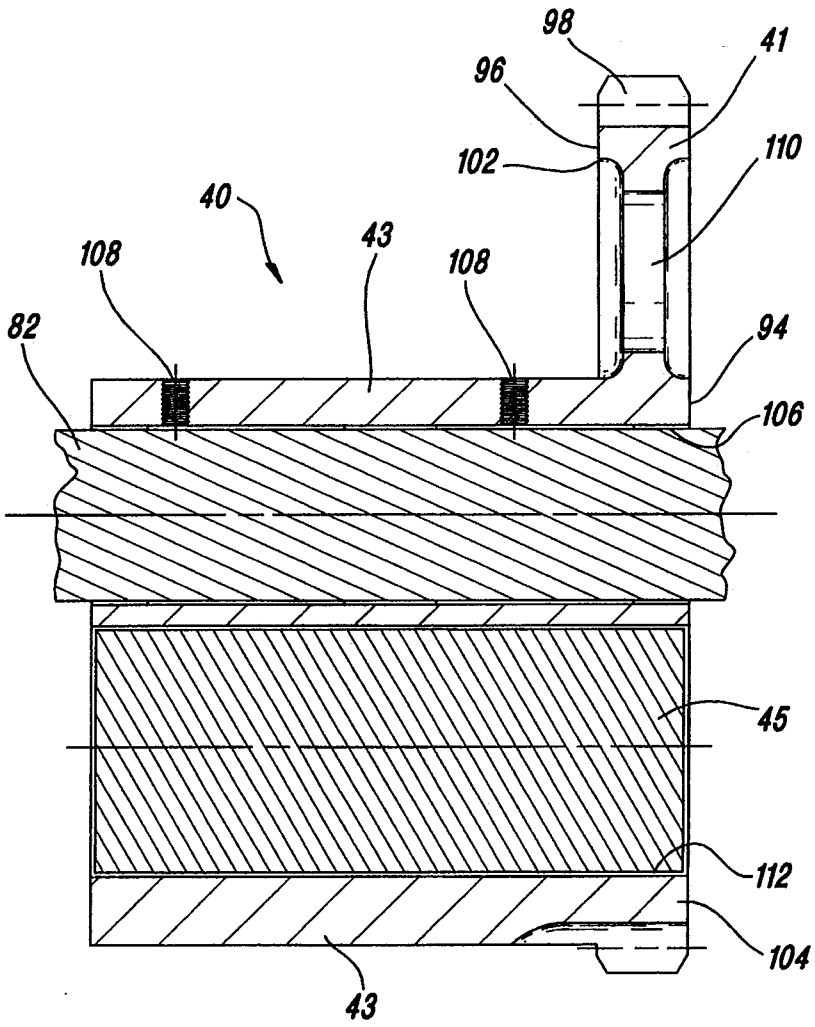
FIG. 3B is a cross-sectional, fragmentary side elevation view of the counterweight of FIG. 3A.
Figure 3A:
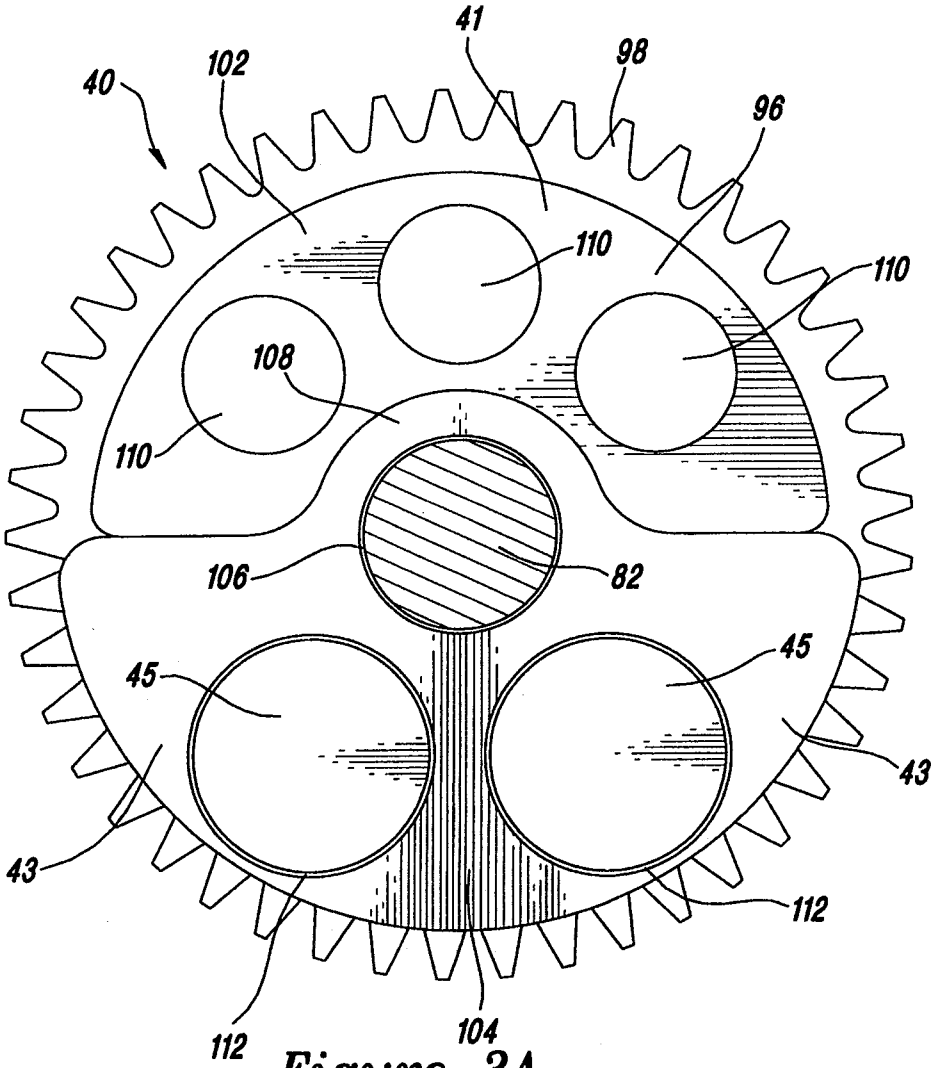
FIG. 3A is an enlarged front elevation view of the counterweight of FIG. 2.

As best seen in FIGS. 3A and 3B, the gear portion 41 of the counterweight 40 is substantially cylindrical and has a rear face 94, a front face 96, and a plurality of gear teeth 98 around its perimeter. The eccentric weight portion 43 of the counterweight 40, which is formed integral with the gear portion 41, extends forward from the front face 96 of the gear portion. The gear portion 41 has a weight distribution with less weight provided by a top portion 102 and more weight provided by a bottom portion 104 as a result of the eccentric weight portion 43 being connected thereto. In the preferred embodiment, the eccentric weight portion 43 has a substantially semi-cylindrical portion 100, and the bottom portion 104 constitutes over one-half of the area of gear portion 41. Accordingly, the counterweight 40 has a large mass of material integral to and projecting from the bottom portion 104 of the gear portion 41, thereby forming a counterweight having a center of gravity located radially outward from the rotational axis of the gear portion.

The counterweight 40 has a center bore 106 that extends fully through the gear portion 41 and the eccentric weight portion 43 and is coaxially aligned with the rotational axis of the gear portion. The center bore 106 has an inner diameter that is slightly larger than the outer diameter of the shaft 82, such that the center bore securely receives the shaft. The eccentric weight portion 43 has two threaded bores 108 that communicate with and are transversely oriented relative to the center bore 106. The threaded bores 108 are adapted to receive conventional threaded lock fasteners to lock the shaft 82 within the center bore 106, thereby securely connecting the counterweight 40 to the shaft for rotation with the shaft.

In the preferred embodiment, the counterweight 40 is a one-piece component that is cast with a predetermined metal, such as steel. The gear portion 41 is cast with a plurality of apertures 110 extending fully through the top portion 102. The apertures 110 effectively reduce the amount of metal in the top portion 102, thereby moving the center of gravity of the counterweight 40 lower or radially away from the rotational axis. As a result, the counterweight 40 can generate greater dynamic forces upon rotation.

The bottom portion 104 of the counterweight 40 is cast having insert receiving areas or bores 112 substantially parallel to the center bore 106 and extending fully through the gear portion 41 and fully through the eccentric weight portion 43. In the preferred embodiment, two insert receiving bores 112 are formed in the counterweight 40, although the number of bores can be varied. The insert receiving bores 112 are shaped to receive the solid insert 45, wherein the solid insert is manufactured from a metal that has a density or specific gravity that is greater than the density or specific gravity of the metal used to form the remainder of the counterweight 40. The preferred solid insert 45 is a tungsten rod machined to close tolerances such that the solid insert fits snugly within the insert receiving bore 112.

The solid inserts 45 add mass to the bottom portion 104 of the counterweight 40, and they move the center of gravity of the counterweight further from the rotational axis of the counterweight. A tungsten rod is used as the preferred solid insert 45 because the metal is very dense and has a melting point temperature far greater than temperatures experienced by the counterweight 40 during operation of the vibratory assembly 34. For example, temperatures can reach approximately 327° C. when operating the vibratory assembly 34, which is the melting point of lead, such that lead will becomes fluid during operation of the vibratory assembly. Tungsten has a melting point temperature of approximately 3,410° C., which is well above the operating temperatures of the vibratory assembly 34. Accordingly, the solid insert 45 is selected to have a melting point temperature of 328° C. or greater.

Referring to FIG. 4, two counterweights 40 fit into the central compartment 70 of the housing 42 such that counterweights are adjacent to each other and the gear portion 41 of one counterweight meshes with the gear portion of the other counterweight. In addition, the center bore 106 of one counterweight is coaxially aligned with the front and rear left apertures 76 and 72 in the center and rear panels 60 and 50, respectively. Similarly, the center bore 106 of the other counterweight 40 is coaxially aligned with the front and rear right apertures 78 and 74 in the center and rear panels 60 and 50, respectively. As indicated above, the shafts 82 extend through the center bores 106 and engage the bearings 80 positioned within the apertures 72, 74, 76, and 78. The counterweights 40 are carried by the shafts 82 and are positioned in the housing 44 with enough room to revolve therein. Each counterweight 40 is fixed within the housing 42 such that rotation of one counterweight 40 in one direction causes the other counterweight to rotate in the opposite direction, resulting in synchronized rotation of the counterweights. Accordingly, the counterweights 40 are rotatably driven by the motors 42, and rotation of the counterweights and associated solid inserts 45 create large dynamic forces which are transmitted to the shafts 82, to the housing 44, and then to the pile holding device 30, as seen in FIG. 2.

For simplicity, the following discussion will only refer to the counterweight 40 in the left side of the housing 44, and it is to be understood that the same description applies to the counterweight on the right side of the housing.

The bearings 80 and shaft 82 mounted in the front and rear left apertures 76 and 72 are protected by cover plates 116 that are connected to the center panel 60 and the rear panel 50. The center panel 60 has an annular shoulder 118 attached to the forward left aperture 76. The cover plates 116 are attached to the center and rear panels 60 and 50 with bolts or other conventional fasteners, such that the cover plate connected to the central panel securely engages the annular shoulder 118, and the cover plate at the rear of the housing securely engages the rear panel.

When the counterweight 40 and its respective shaft 82 is installed in the housing 44, the plurality of gear teeth 98 around the cylindrical gear portion 41 engage a drive gear 120 that is positioned adjacent to the cylindrical gear portion. The drive gear 120 is a cylindrical gear having a plurality of gear teeth 122 around its circumference, and the gear teeth are sized and shaped to drivingly mesh with the gear teeth 98 around the gear portion 41. The drive gear 120 fits in the side compartment 68 between the rear panel 50 and the left front panel 58.

The drive gear 120 has a central bore 124 that coaxially aligns with the side aperture 84 in the left front panel 58 when the drive gear is installed. The central bore 124 is adapted to securely receive the shaft of the drive motor 42 mounted to the left front panel 58. Accordingly, the drive gear 120 on the left side of the housing is driven by the drive motor 42 connected to the left front panel 58, which drives the left counterweight and causes both counterweights 40 to rotate in opposite directions. The motor 42 on the right side of the housing drives the right counterweight 40 and is synchronized with the left motor to turn the counterweights in concert.

When the drive motor 42 is activated, the drive motor turns its shaft, which causes the drive gear 120 and its associated gear teeth 124 to rotate within the side compartment 68. As the drive gear 120 rotates, its gear teeth 124 impart a driving force on the gear teeth 98 of the gear portion 41, thereby causing the counterweight 40 to rotate on the shaft 82 within the central compartment 70. When both drive motors 42 are operating, the motors work together to simultaneously rotate the two counterweights 40 within the housing 44. The hydraulic motor 42 of the preferred embodiment operate at very high rates of speed, such that the counterweights will rotate at up to 2,000 RPMs. The counterweights 40 are counter-rotated, e.g., rotated in opposite directions with the eccentric weight portions 43 of each counterweight moving to the highest and lowest points of their respective revolving travel at almost exactly the same time. In addition, the eccentric weight portions 43 move in opposite horizontal directions throughout each revolution.

As a result, the synchronized, counter-rotating counterweights 40 generate substantial vertical forces that will be transmitted to the pile 22. Furthermore, the lateral forces that are generated by one rapidly revolving counterweight 40 having the eccentric weight portion 43 cancels out the large lateral forces generated by a matching counter-rotating counterweight, such that the vibratory assembly 34 experiences very limited overall lateral forces as a result of the rotation of the counterweights.

Although the preferred embodiment has two counterweights 40 within the housing 44, the vibratory device 34 can have a different number of counterweights to achieve the desired vibratory force. For example, a second embodiment of the vibratory assembly (not shown) has four counterweights with two pairs of matched counterweights. Each of the counterweights weigh over 400 pounds. Rotation of each of these counterweights generates tremendous vertical forces that are imparted to the pile.

Referring again to FIGS. 3A, 3B, and 4, the vibratory assembly 34 generates the vertical forces which cause the vibratory assembly 34 to move through a vertical amplitude of approximately $1\frac{1}{8}''$ per revolution. To achieve this vertical amplitude, the counterweights 40 are made in matched and balanced pairs. Each counterweight 40 is formed by casting steel or other suitable metal with the apertures 110, center bore 106, and the insert receiving bores 112 formed therein. After casting the counterweights 40, the apertures 110, center bores 106, and insert receiving bores 112 are machined to a desired size and shape, e.g., by drilling or reaming material out of the cast apertures and bores. Then, the solid insert members 45 which have a predetermined precise size and weight are slid into the insert receiving bores 112 and secured in place. In the preferred embodiment, the solid tungsten rods used as the solid insert members 45 are secured within the insert receiving bores 112 by applying an adhesive to the tungsten rod, and then inserting the rod into its insert receiving bore. The tungsten rods are also secured within the insert receiving bores 112 by slight expansion of the metals as a result of the high temperatures generated during operation. Notwithstanding the expansion, the adhesive is strong enough to hold the tungsten rod within the eccentric weight portion during extended operation of the vibratory assembly.

After inserting both of the tungsten rods, the counterweight 40 is balanced. A balancing shaft (not shown) is temporarily inserted into the center bore 106, and the balancing shaft and counterweight are placed on a balancing rack that allows the counterweight to freely rotate until gravity pulls the eccentric weight portion 43 to the lowest point. Thus, the center of gravity of the counterweight and insert assembly is closest to the ground and in an equilibrium position. In the preferred embodiment, the balancing shaft is placed on two blade members of the balancing rack wherein the counterweight 40 is between the blade members such that the blade members do not inhibit rotation of the balancing shaft and the counterweight can freely rotate to the equilibrium position.

While the counterweight 40 is in the equilibrium position, the location of the very top of the gear portion 41 is determined utilizing a height gauge, and a scribe mark is made on the gear portion at its top. This scribe mark is used to determine a proper orientation for the gear teeth 98. Each counterweight 40 is then weighed, and its weight is compared to that of a second counterweight that has been cast, machined, balanced, and scribed. The second counterweight will be the first counterweight's mate when installed in the vibratory assembly 34. If one counterweight is heavier than the other counterweight, mass is removed from the heavier counterweight by drilling a hole, or the like, in the eccentric weight portion. This process is performed until the counterweights 40 have approximately the same weight.

The counterweights 40 are then removed from the balancing device and the balancing shaft is removed from the center bore 106. Each counterweight 40 is then placed on a gear tooth cutting device (not shown) and aligned such that the scribe mark on the gear portion 41 determines where the first gear tooth is to be cut. The cutting device then cuts the gear teeth 98 around the circumference of the gear portion 41. The gear teeth 98 are cut such that they will properly mesh with the gear teeth 122 on the drive gear 120. In one embodiment (not shown), the gear teeth on the gear portion are cut to form a helical gear portion that properly meshes with gear teeth on a helical drive gear. An accurate gear tooth cutting step is critical to obtain a matched pair of counterweights that will rotate within the housing and reach the same relative positions at the same time during each revolution.

As the gear teeth 98 are cut, metal is removed from the counterweight 40, thereby changing the weight or mass of the counterweight. Thus, each of the two counterweights 40 are weighed again and the weights are compared. If one counterweight is heavier than the other, additional mass is removed from the heavier counterweight in the same manner as discussed above. Each counterweight 40 is balanced again on the balancing device to assure that the eccentric weight portion 43 hangs at its lowest point of a revolution when the counterweight is at the equilibrium position. If the eccentric weight portion 41 does not hang properly, metal may be removed from the eccentric weight portion to achieve a properly balanced counterweight. Accordingly, the resulting pair of counterweights 40 are of equal weight and balanced to assure that the dynamic forces generated by each counterweight will be substantially the same.

Numerous modifications and variations of the vibratory apparatus disclosed herein will occur to those skilled in the art in view of this disclosure. For example, the solid tungsten rod may be replaced with a different solid material having a suitable specific gravity and melting temperature. Therefore, it is to be understood that these modifications and variations, and equivalents thereof may be practiced while remaining within the spirit and the scope of the invention as defined by the following claims.

We claim:

1. A vibratory assembly for imparting a vibratory force to a pile, comprising:

a housing having at least one counterweight receiving means;

a counterweight rotatably carried in said receiving means for rotation about a rotational axis, said counterweight having a cylindrical gear portion and an eccentric weight portion integral with said cylindrical gear portion, said eccentric weight portion having at least one insert-receiving area formed therein, said counterweight being made of a first metal;

a solid insert member securely positioned in one of said at least one insert-receiving areas said solid insert member being made of a second metal having a specific gravity greater than the specific gravity of said first metal, and a melting point temperature of 328° C. or greater; and at least one driving means operatively connected to said counterweight and adapted to rotate said counterweight about its rotational axis.

2. The vibratory assembly of claim 1 wherein said first metal is steel and said second metal is tungsten.

3. The vibratory assembly of claim 1 wherein said at least one insert-receiving area is a bore in said eccentric weight portion and said solid insert member is a tungsten rod.

4. The vibratory assembly of claim 1 wherein said solid insert member is adhered within one of said at least one insert-receiving areas by an adhesive.

5. The vibratory assembly of claim 1 wherein said at least one driving means is a hydraulic motor.

6. A vibratory assembly for imparting a vibratory force to a pile, comprising:

a housing having first and second counterweight receiving means;

a first counterweight rotatably carried in said first receiving means for rotation about a rotational axis, said first counterweight having a cylindrical gear portion and an eccentric weight portion integral with said cylindrical gear portion, said eccentric weight portion having at least one insert-receiving area formed therein, said first counterweight being made of a first metal;

a second counterweight rotatably carried in said second receiving means for rotation about a rotational axis, said second counterweight having a cylindrical gear portion and an eccentric weight portion integral with said cylindrical gear portion, said eccentric weight portion having at least one insert-receiving area formed therein, said second counterweight being made of said first metal;

a first solid insert member securely positioned in one of said at least one insert-receiving area of said first counterweight, said first solid insert member being made of a second metal having a specific gravity greater than the specific gravity of said first metal, and a melting point temperature of 328° C. or greater;

a second solid insert member securely positioned in one of said at least one insert-receiving area of said second counterweight, said second solid insert member being made of said second metal; and at least one driving means operatively connected to said first and second counterweights and adapted to rotate said first and second counterweights about their rotational axis.

7. The vibratory assembly of claim 6, said at least one driving means further comprising a first drive operatively coupled to said first counterweight, and a second drive operatively coupled to said second counterweight.

8. The vibratory assembly of claim 6 wherein said first metal is steel and said second metal is tungsten.

9. The vibratory assembly of claim 6 wherein said solid insert member is a machined tungsten rod.

10. The vibratory assembly of claim 6 wherein said at least one driving means is a hydraulic motor.

11. A vibratory assembly for imparting a vibratory force to a pile, comprising:

a housing having an even number of counterweight receiving means;

an even number of counterweights, said counterweights being rotatably carried in said counterweight receiving means for rotation about a rotational axis, each of said counterweights having a cylindrical gear portion and an eccentric weight portion integral with said cylindrical gear portion, said eccentric weight portion having at least one insert-receiving area formed therein, said counterweights being made of a first metal;

a plurality of solid insert members, at least one of said solid insert members securely positioned in said at least one insert-receiving areas of said counterweights respectively, each of said solid insert members being made of a second metal having a specific gravity greater than the specific gravity of said first metal, and a melting point temperature of 328° C. or greater; and at least one driving means operatively connected to said counterweights and adapted to rotate each of said counterweights about their rotational axis.

12. The vibratory assembly of claim 11 wherein said first metal is steel and said second metal is tungsten.

13. The vibratory assembly of claim 11 wherein said solid insert member is a machined tungsten rod.

14. The vibratory assembly of claim 11 wherein said at least one driving means is a hydraulic motor.

15. The vibratory assembly of claim 11 wherein said solid insert members are adhered within corresponding insert-receiving areas by an adhesive.

16. A counterweight assembly for use in a vibratory pile driver and/or pile puller, comprising:

a cylindrical gear portion having a plurality of gear teeth around its circumference, said cylindrical gear portion being made of a first metal;

an eccentric weight portion connected to said cylindrical gear portion at a position radially outward of the axis of said cylindrical gear portion, said eccentric weight portion having at least one insert-receiving area therein, said eccentric weight portion being made of said first metal; and at least one solid insert member having a predetermined size securely positioned in said at least one insert-receiving area respectively, said at least one solid insert member being made of a second metal having a specific gravity greater than the specific gravity of said first metal and a melting point temperature of 328° C. or greater.

17. The counterweight assembly of claim 16 wherein said first metal is steel and said second metal is tungsten.

18. The counterweight assembly of claim 16 wherein said at least one solid insert member is a tungsten rod.

19. The counterweight assembly of claim 16 wherein said eccentric weight portion is integral with said cylindrical gear portion, said first metal is cast steel, and said second metal is a tungsten.

20. The counterweight assembly of claim 19 wherein said at least one solid insert member is a tungsten rod, and said tungsten rod is adhered within said at least one insert-receiving area by an adhesive.

21. A method of making a counterweight assembly of a vibratory device for imparting a vibratory force to a pile, comprising the steps of:

forming with a first metal a counterweight having a cylindrical gear portion and an eccentric weight portion integral with the cylindrical gear portion, a coaxially aligned aperture through said cylindrical gear and eccentric weight portions and adapted to receive a shaft, and at least one insert-receiving area in said eccentric weight adapted to receive a solid insert member;

providing a solid insert member sized to fit within the at least one insert-receiving area from a second metal having a specific gravity greater than the specific gravity of the first metal and a melting point of 328° C. or greater;

inserting the solid insert member into the at least one insert-receiving area;

securing the solid insert member within said at least one insert-receiving area;

forming a plurality of gear teeth around the circumference of the cylindrical gear portion; and balancing the counterweight assembly such that the center of gravity of the eccentric weight portion is aligned with the gear teeth.

22. The method of claim 21, further comprising the step of machining the at least one insert-receiving area such that the inside dimensions of the receiving area is slightly larger than the outside dimensions of the solid insert member.

23. The method of claim 21 wherein said step of forming the counterweight comprises casting the counterweight.

24. The method of claim 21 wherein said step of securing the solid insert member comprises adhering the solid insert member within said at least one insert-receiving area by an adhesive.

25. The method of claim 21 wherein said step of forming a plurality of gear teeth comprises cutting a plurality of gear teeth.

26. The method of claim 21 wherein said balancing step includes removing mass from the eccentric weight portion to move the center of gravity of the eccentric weight portion.

27. A method of making a counterweight assembly of a vibratory device for imparting a vibratory force to a pile, comprising the steps of:

casting with a first metal a counterweight having a cylindrical gear portion and an eccentric weight portion integral with the cylindrical gear portion, a coaxially aligned aperture through said cylindrical gear and said eccentric weight portion and adapted to receive a shaft, and at least one insert-receiving area in said eccentric weight adapted to receive a solid insert member;

boring the at least one insert-receiving area such that the inside dimensions of the receiving area is slightly larger than the outside dimensions of the solid insert member;

providing the solid insert member being made of tungsten and having a specific gravity greater than the specific gravity of said first metal and sized to fit within the at least one insert-receiving area;

inserting the solid insert-member into the at least one insert-receiving area;

adhering the solid insert member within said insert-receiving area with an adhesive;

cutting a plurality of gear teeth around the circumference of the cylindrical gear portion; and balancing the counterweight assembly such that the center of gravity of the eccentric weight portion is aligned with the gear teeth.

* * * * *

UNITED STATES PATENT AND TRADEMARK OFFICE

CERTIFICATE OF CORRECTION

PATENT NO. : 5,355,964
DATED : October 18, 1994
INVENTOR(S) : John L. White

It is certified that error appears in the above-indentified patent and that said Letters Patent is hereby corrected as shown below:

In column 12, claim 27, line 48, after "said" and before "insert-receiving" please insert --at least one --.

Signed and Sealed this

Twenty-first Day of February, 1995

*Attest:*

*Attesting Officer*

BRUCE LEHMAN

*Commissioner of Patents and Trademarks*

US005355964C1

(12) EX PARTE REEXAMINATION CERTIFICATE (5747th)

United States Patent
White

(10) Number: US 5,355,964 C1
(45) Certificate Issued: Apr. 24, 2007

(54) PILE DRIVING AND/OR PILE PULLING VIBRATORY ASSEMBLY WITH COUNTERWEIGHTS

(75) Inventor: John L. White, Kent, WA (US)

(73) Assignee: American Pile Driving Equipment, Inc., Kent, WA (US)

Reexamination Request:
No. 90/007,337, Dec. 9, 2004

Reexamination Certificate for:

| | |
|---|---|
| Patent No.: | **5,355,964** |
| Issued: | **Oct. 18, 1994** |
| Appl. No.: | **08/090,891** |
| Filed: | **Jul. 12, 1993** |

Certificate of Correction issued Feb. 21, 1995.

(51) Int. Cl.
*E02D 7/18* (2006.01)
*E21B 7/24* (2006.01)

(52) U.S. Cl. ..... 173/1; 173/49; 173/56; 405/232

(58) Field of Classification Search ..... 173/49, 173/141, 162.1, 1; 405/232; 175/56
See application file for complete search history.

(56) References Cited

U.S. PATENT DOCUMENTS

| | | | |
|---|---|---|---|
| 3,224,514 A | 12/1965 | Hornstein et al. | 175/55 |
| 4,819,740 A | 4/1989 | Warrington | 173/49 |

*Primary Examiner*—Sara Clarke

(57) ABSTRACT

A pile driving and/or pile pulling vibratory assembly for imparting a vibratory force to a pile wherein the vibratory assembly has a housing and a pair of counterweights rotatably carried in receiving areas within the housing. The counterweight has a cylindrical gear portion and an eccentric weight portion integrally formed therewith. The eccentric weight portion has insert-receiving areas therein that are adapted to each receive a solid tungsten rod. The solid tungsten rod is adhered within the insert receiving area with an adhesive. Driving motors are operatively connected to the counterweights and are adapted to rapidly rotate the counterweights within the housing in order to generate substantial vibratory forces.

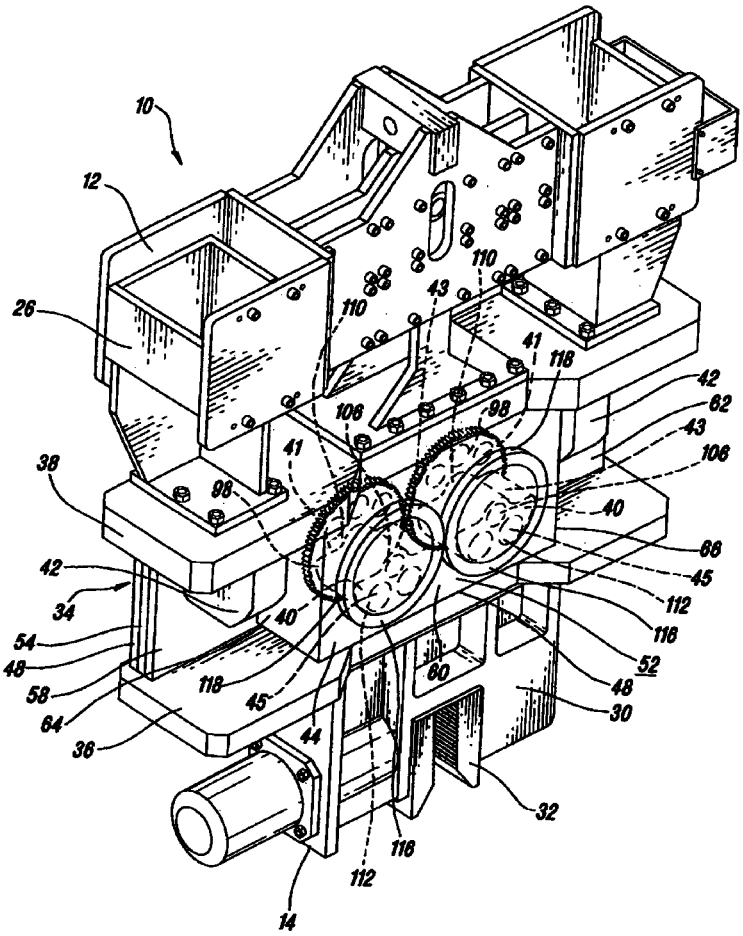

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–27 is confirmed.

* * * * *